US009720344B1

(12) United States Patent
Hamada

(10) Patent No.: US 9,720,344 B1
(45) Date of Patent: Aug. 1, 2017

(54) IMAGE FORMING APPARATUS, IMAGE FORMING METHOD, AND NON-TRANSITORY COMPUTER READABLE MEDIUM

(71) Applicant: FUJI XEROX CO., LTD., Tokyo (JP)

(72) Inventor: Hirofumi Hamada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/218,151

(22) Filed: Jul. 25, 2016

(30) Foreign Application Priority Data

Feb. 25, 2016 (JP) ..... 2016-034531

(51) Int. Cl.
*G03G 15/02* (2006.01)

(52) U.S. Cl.
CPC ..... *G03G 15/0266* (2013.01)

(58) Field of Classification Search
CPC ..... G03G 15/0266
USPC ..... 399/50
See application file for complete search history.

(56) References Cited

U.S. PATENT DOCUMENTS 5,636,009 A * 6/1997 Honda ..... G03G 15/0266 399/176
5,794,097 A * 8/1998 Shinkawa ..... G03G 21/08 399/128
2003/0016961 A1* 1/2003 Kitajima ..... G03G 15/0266 399/50
2010/0239280 A1 9/2010 Inoue

FOREIGN PATENT DOCUMENTS

JP 2003-140526 A 5/2003
JP 2010-217627 A 9/2010

* cited by examiner

*Primary Examiner* — Susan Lee
(74) *Attorney, Agent, or Firm* — Sughrue Mion, PLLC

(57) ABSTRACT

An image forming apparatus includes a charger, a charge eliminator, and a controller. The charger charges a surface of an image carrier. The charge eliminator eliminates residual charge from the surface of the image carrier charged by the charger. The controller performs control to reduce a level of charge elimination performed by the charge eliminator during a third period compared to a level of charge elimination performed by the charge eliminator during a second period in which an image for determining an image-forming condition is formed. The third period is a period other than the second period within a first period that is a period, other than a period of normal image formation, during which the surface of the image carrier is charged by the charger.

6 Claims, 4 Drawing Sheets

IMAGE FORMING APPARATUS, IMAGE FORMING METHOD, AND NON-TRANSITORY COMPUTER READABLE MEDIUM

CROSS-REFERENCE TO RELATED APPLICATIONS

This application is based on and claims priority under 35 USC 119 from Japanese Patent Application No. 2016-034531 filed Feb. 25, 2016.

BACKGROUND

Technical Field

The present invention relates to an image forming apparatus, an image forming method, and a non-transitory computer readable medium.

SUMMARY

According to an aspect of the invention, there is provided an image forming apparatus including a charger, a charge eliminator, and a controller. The charger charges a surface of an image carrier. The charge eliminator eliminates residual charge from the surface of the image carrier charged by the charger. The controller performs control to reduce a level of charge elimination performed by the charge eliminator during a third period compared to a level of charge elimination performed by the charge eliminator during a second period in which an image for determining an image-forming condition is formed. The third period is a period other than the second period within a first period that is a period, other than a period of normal image formation, during which the surface of the image carrier is charged by the charger.

BRIEF DESCRIPTION OF THE DRAWINGS

An exemplary embodiment of the present invention will be described in detail based on the following figures, wherein.

DETAILED DESCRIPTION

Figure 1:
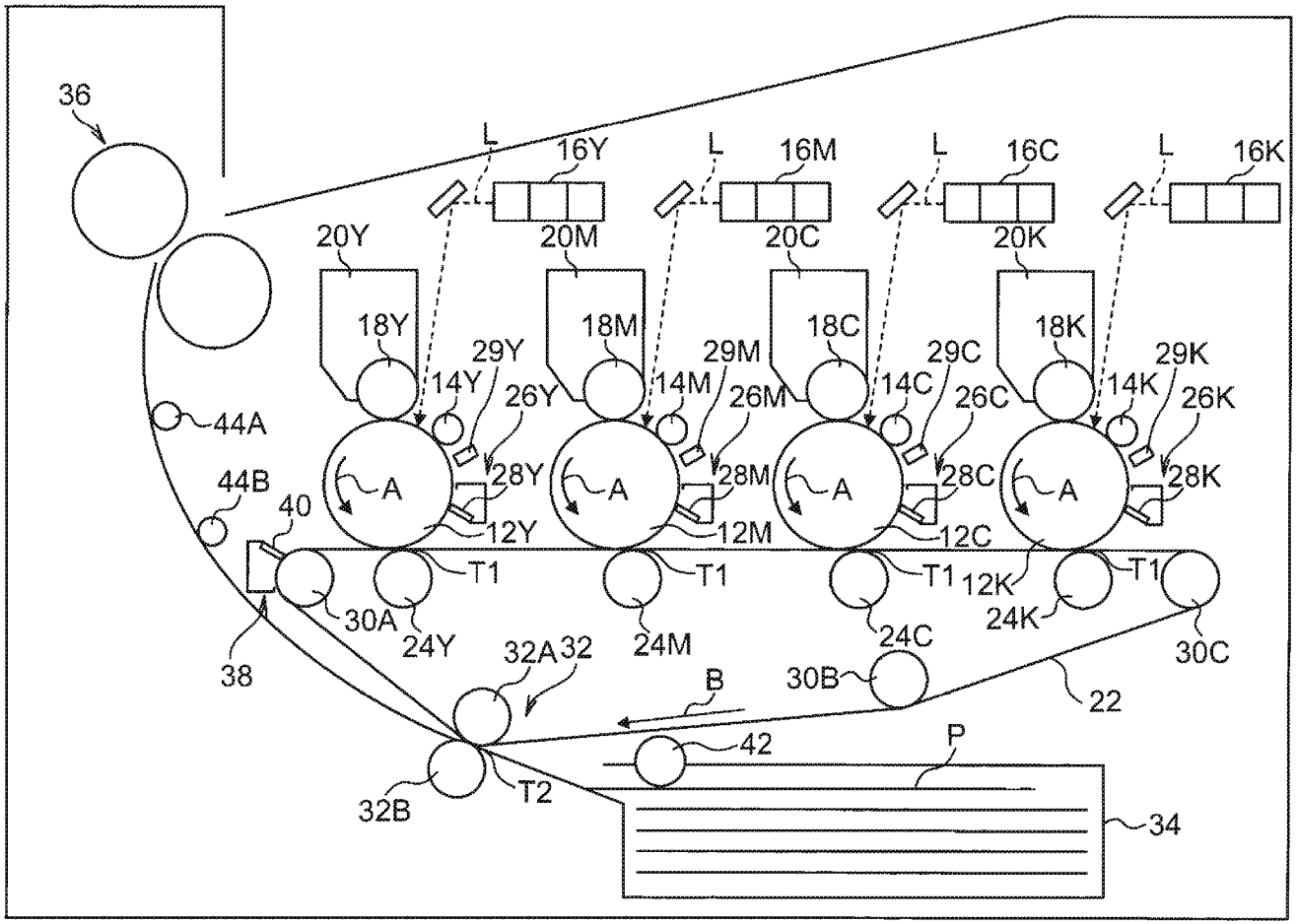
FIG. 1 is a schematic configuration diagram (cutaway side view) illustrating the configuration of an image forming apparatus according to an exemplary embodiment.

An exemplary embodiment of the present invention will be described in detail hereinafter with reference to the drawings.

First, the configuration of an image forming apparatus 10 according to this exemplary embodiment will be described with reference to FIG. 1. In the following description, yellow is represented by Y, magenta by M, cyan by C, and black by K. In addition, components and toner images are each represented by a numeral suffixed with the sign "Y", "M", "C", or "K" to indicate the corresponding color so as to be identified by color. In the following description, furthermore, if the components and toner images are designated by general terms without being identified by color, the suffixes for the respective colors added to the numerals are omitted.

The image forming apparatus 10 according to this exemplary embodiment includes four photoconductors 12 for the respective colors of Y, M, C, and K. The photoconductors 12 rotate in a direction indicated by the arrow A in FIG. 1. The image forming apparatus 10 further includes charging devices 14. Each of the charging devices 14 applies a charging bias to charge a surface of the corresponding one of the photoconductors 12. The image forming apparatus 10 according to this exemplary embodiment applies a voltage (hereinafter referred to as "superimposition voltage") obtained by superimposing an alternating-current (AC) voltage on a direct-current (DC) voltage to the charging devices 14 to cause the charging devices 14 to charge the surfaces of the respective photoconductors 12. The charging devices 14 are an example of a charger.

The image forming apparatus 10 further includes laser output units 16. Each of the laser output units 16 exposes the charged surface of the corresponding one of the photoconductors 12 to exposure light to form an electrostatic latent image on the photoconductor 12. The exposure light is light modulated based on image data of the corresponding color.

The image forming apparatus 10 further includes developing devices 20. Each of the developing devices 20 applies a developing bias to a corresponding one of developing rollers 18 by using a developing bias power supply (not illustrated) to develop the electrostatic latent image on the corresponding photoconductor 12 with toner of the corresponding color to form a toner image on the photoconductor 12. The image forming apparatus 10 further includes first transfer devices 24. The first transfer devices 24 transfer the toner images on the respective photoconductors 12 onto an intermediate transfer belt 22 at transfer positions T1.

The image forming apparatus 10 further includes cleaning devices 26 downstream of the transfer positions T1 along the surfaces of the respective photoconductors 12 in the direction of rotation of the photoconductors 12. Each of the cleaning devices 26 includes a cleaning blade 28 that removes residual toner from the surface of the corresponding one of the photoconductors 12 after the first transfer operation.

The image forming apparatus 10 further includes erase lamps 29 downstream of the cleaning devices 26 and upstream of the charging devices 14 along the surfaces of the respective photoconductors 12 in the direction of rotation of the photoconductors 12. The erase lamps 29 according to this exemplary embodiment each illuminate the surface of the corresponding one of the photoconductors 12 with erase light to remove residual charge from the surface of the photoconductor 12 after the first transfer operation. The erase lamps 29 are an example of a charge eliminator.

The intermediate transfer belt 22 is stretched around rollers 30A to 30C and a backup roller 32A of a second transfer device 32 described below. The image forming apparatus 10 further includes a sheet accommodating unit 34, the second transfer device 32, and a fixing device 36. The sheet accommodating unit 34 accommodates sheets P, which are a non-limiting example of a recording medium. The second transfer device 32 is configured to transfer the toner images on the intermediate transfer belt 22 onto a sheet P at a transfer position T2. The fixing device 36 fixes the toner images transferred onto the sheet P.

The image forming apparatus 10 further includes a cleaning device 38 downstream of the transfer position T2 along the surface of the intermediate transfer belt 22 in a direction indicated by the arrow B in FIG. 1. The cleaning device 38 includes a cleaning blade 40 that removes residual toner from the surface of the intermediate transfer belt 22 after the second transfer operation.

Next, an image forming process performed in the image forming apparatus 10 according to this exemplary embodiment will be described.

When image data indicating an image to be formed is input, the image forming apparatus 10 starts the driving (or rotation) of each of the photoconductors 12 and applies a superimposition voltage to the corresponding charging device 14 to negatively charge the surface of the photoconductor 12. After the image data is decomposed into pieces of image data for the respective CMYK colors, the image forming apparatus 10 outputs modulation signals based on the pieces of image data for the respective colors to the laser output units 16 of the corresponding colors. The laser output units 16 output laser beams L modulated in accordance with the respective input modulation signals.

The modulated and output laser beams L are each applied to the surface of the corresponding one of the photoconductors 12. When the surface of the photoconductor 12, which is negatively charged by the corresponding charging device 14, is irradiated with the laser beam L, the charge disappears in a portion to which the laser beam L is applied. An electrostatic latent image corresponding to the image data for each of the CMYK colors is thus formed on the photoconductor 12.

When the electrostatic latent image formed on the photoconductor 12 reaches the position where the developing roller 18 of the developing device 20 is located, a developing bias is applied to the developing roller 18 by the developing bias power supply (not illustrated). Then, toner particles of the corresponding color, which are held on the circumferential surface of the developing roller 18, adhere to the electrostatic latent image on the photoconductor 12. Accordingly, a toner image corresponding to the image data of the corresponding color is formed on the photoconductor 12.

Furthermore, the intermediate transfer belt 22 rotates in accordance with the rotation of the rollers 30A to 30C and the backup roller 32A of the second transfer device 32 by a motor (not illustrated). When a first transfer bias is applied to the first transfer devices 24, the toner images of the respective colors, which are formed on the photoconductors 12, are transferred onto the intermediate transfer belt 22. Controlling the rotation of the rollers 30A to 30C and the backup roller 32A to align the positions at which the toner images of the respective colors start to be transferred onto the intermediate transfer belt 22 allows the toner images of the respective colors to be brought together. Accordingly, a toner image corresponding to the image data is formed on the intermediate transfer belt 22.

Each of the photoconductors 12 from which the respective toner images have been transferred onto the intermediate transfer belt 22 is subjected to removal of substances adhering to the surface thereof, such as residual toner, by the cleaning blade 28, and is then irradiated with erase light from the erase lamp 29 to remove residual charge from the surface.

The second transfer device 32 includes the backup roller 32A and a second transfer roller 32B, for example. The backup roller 32A supports the intermediate transfer belt 22. The second transfer roller 32B cooperates with the backup roller 32A to hold a sheet P and the intermediate transfer belt 22 between them. Since the intermediate transfer belt 22 is held between the backup roller 32A and the second transfer roller 32B, as the intermediate transfer belt 22 rotates, the backup roller 32A and the second transfer roller 32B also rotate accordingly.

Furthermore, a sheet transport roller 42 is rotated by a motor (not illustrated). This causes a sheet P in the sheet accommodating unit 34 to be transported to a nip defined between the backup roller 32A and the second transfer roller 32B.

When the toner image on the intermediate transfer belt 22 is held in the nip between the backup roller 32A and the second transfer roller 32B, a second transfer bias is applied to the backup roller 32A to thereby transfer the toner image formed on the intermediate transfer belt 22 onto the sheet P. The sheet P is transported by means of intermediate transport rollers 44A and 44B to the position at which the fixing device 36 is located, and the toner image transferred onto the sheet P is heated and fused by the fixing device 36 to fix the toner image on the sheet P.

The intermediate transfer belt 22 from which the toner image has been transferred onto the sheet P is subjected to removal of substances adhering to the surface thereof, such as residual toner, by the cleaning blade 40.

The configuration of the principal electrical components of the image forming apparatus 10 according to this exemplary embodiment will now be described with reference to FIG. 2.

Figure 2:
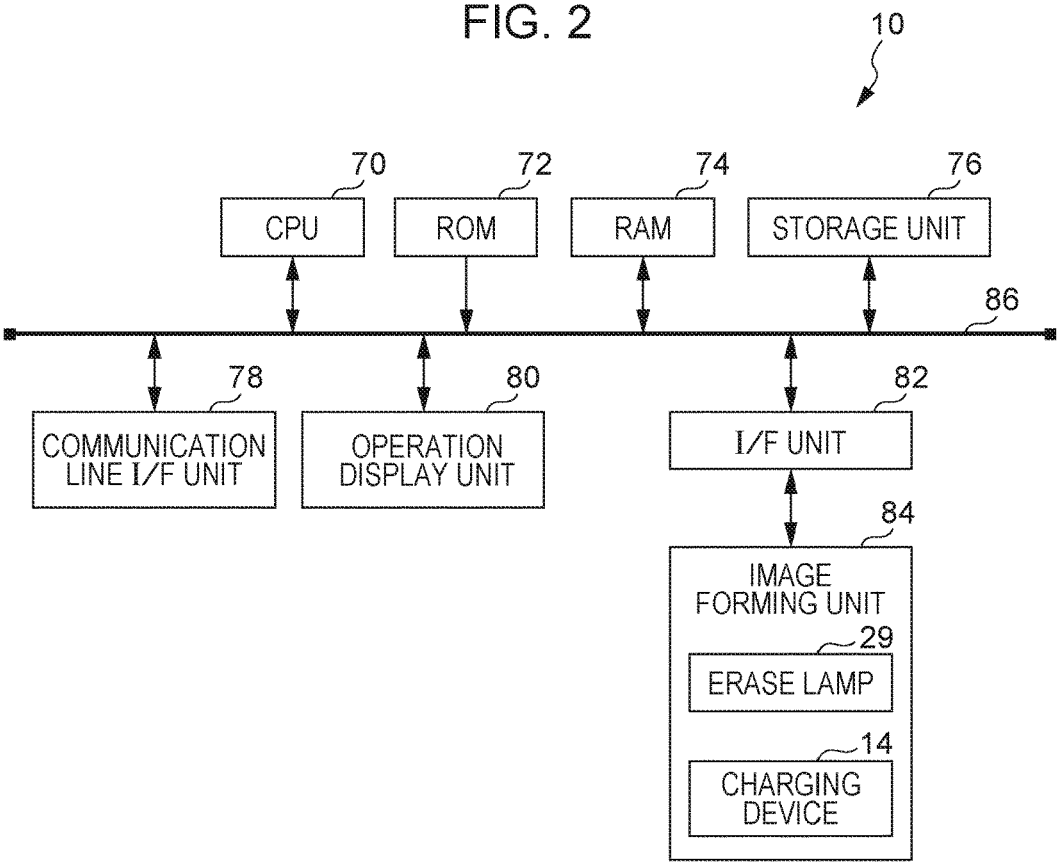
FIG. 2 is a block diagram illustrating the configuration of the principal electrical components of the image forming apparatus according to the exemplary embodiment.

As illustrated in FIG. 2, the image forming apparatus 10 according to this exemplary embodiment includes a central processing unit (CPU) 70 and a read-only memory (ROM) 72. The CPU 70 controls the overall operation of the image forming apparatus 10. The ROM 72 stores various programs and various parameters in advance. The image forming apparatus 10 further includes a random access memory (RAM) 74 and a non-volatile storage unit 76 such as a flash memory. The RAM 74 is used as, for example, a work area when the CPU 70 executes the various programs.

The image forming apparatus 10 further includes a communication line interface (I/F) unit 78 that transmits and receives communication data to and from an external device. The image forming apparatus 10 further includes an operation display unit 80 and an I/F unit 82. The operation display unit 80 accepts instructions given to the image forming apparatus 10 from a user, and also displays to the user various kinds of information related to the operation state and the like of the image forming apparatus 10. The operation display unit 80 includes a display and hardware keys such as a ten-key pad and a start button. The display has a touch panel on a display surface thereof on which, for example, display buttons implementing acceptance of operation instructions in accordance with the execution of a program or various kinds of information are displayed.

The image forming apparatus 10 further includes an image forming unit 84. The image forming unit 84 includes the components for performing various processing operations related to image formation in the image forming process described above, such as the photoconductors 12, the charging devices 14, the laser output units 16, and the erase lamps 29. In FIG. 2, the components of the image forming unit 84, other than the charging devices 14 and the erase lamps 29, are not illustrated to avoid the diagram becoming too complex.

The CPU 70, the ROM 72, the RAM 74, the storage unit 76, the communication line I/F unit 78, the operation display unit 80, and the I/F unit 82 are connected to one another via a bus 86, such as an address bus, a data bus, and a control bus. The image forming unit 84 is connected to the I/F unit 82.

In the image forming apparatus 10 according to this exemplary embodiment, as described above, the surface of each of the photoconductors 12 is irradiated with erase light from the corresponding erase lamp 29 to remove residual charge from the surface. If the erase lamp 29 is constantly kept in an on state during a period in which the photoconductor 12 is driven (or rotated) and is charged by the charging device 14, the surface of the photoconductor 12 will be subjected to repeated application and elimination of charge by the charging device 14 and the erase lamp 29, respectively, which may lead to accelerated wear and the like of the surface of the photoconductor 12.

To address this issue, the image forming apparatus 10 according to this exemplary embodiment performs control to change the level of charge elimination performed by the erase lamp 29 in accordance with the condition even during a period in which the photoconductor 12 is driven and is charged by the charging device 14. Specifically, in the image forming apparatus 10 according to this exemplary embodiment, a first period, other than a period of normal image formation, during which the surface of each of the photoconductors 12 is charged by the corresponding charging device 14 is divided into a second period and a third period.

The term "normal image formation", as used herein, refers to the formation of an image indicated by input image data on a sheet P in response to, for example, user input of the image data and instructions for forming an image. The image data indicates an image to be formed.

The image forming apparatus 10 according to this exemplary embodiment performs control to reduce the level of charge elimination performed by the erase lamp 29 during the third period compared to the level of charge elimination performed by the erase lamp 29 during the second period. Specifically, the image forming apparatus 10 according to this exemplary embodiment controls the erase lamp 29 to be kept in an on state during the second period and in an off state during the third period.

The second period and the third period will now be described. The second period according to this exemplary embodiment is a period during which the image forming unit 84 forms an image for determining an image-forming condition. Specifically, the second period is a period during which the image forming unit 84 forms an image that is formed to determine an image-forming condition from image data obtained by reading, by an image reading unit (not illustrated), an image formed on a sheet P by the image forming unit 84.

Examples of the image-forming condition include the density of an image to be formed by the image forming unit 84. For example, input image data indicating a patch image is stored in the storage unit 76 in advance and a patch image based on the input image data is formed on a sheet P by the image forming unit 84. In accordance with the difference in density between the input image data and output image data obtained by reading, by the image reading unit, the patch image formed on the sheet P, correction data used to subject an input image to gradation correction is generated. The period during which the image forming unit 84 forms a patch image to generate the correction data is a non-limiting example of the second period.

Examples of the image-forming condition further include the formation position at which an image is formed by the image forming unit 84 in an intersection direction intersecting (in this exemplary embodiment, perpendicular to) the direction in which the sheet P is transported. In this case, for example, a detection image used to detect a shift (called a misregistration) of the formation position from the intersection direction is formed on a sheet P by the image forming unit 84. Then, the degree of misregistration is detected from image data obtained by reading, by the image reading unit, the detection image formed on the sheet P, and a formation position at which an image is formed by the image forming unit 84 is determined so as to reduce the degree of misregistration as much as possible. The period during which the image forming unit 84 forms a detection image to determine such a formation position is another non-limiting example of the second period.

The third period according to this exemplary embodiment is a period other than the second period within the first period. Examples of the third period include a period during which the surface of each of the photoconductors 12 is charged by the charging device 14 but no image is formed, and a period during which no consideration may be given to the quality of an image formed by the image forming unit 84.

In a non-limiting example, the third period may be a period during which a toner band is formed on the surface of each of the photoconductors 12 by the image forming unit 84. The toner band is a band-shaped image whose longitudinal direction coincides with the direction of the rotation axis of the photoconductor 12. The formation of a toner band is periodically performed to maintain the lubrication of a surface of the cleaning blade 28 that comes into contact with the photoconductor 12, for example.

In another non-limiting example, the third period may be a period during which the surface of each of the photoconductors 12 is charged by the corresponding charging device 14 with the photoconductor 12 rotating and without supply of toner from the corresponding developing device 20 (i.e., without the formation of an image). In the following, the operation of causing the charging device 14 to charge the surface of the photoconductor 12 with the photoconductor 12 rotating and without supply of toner from the developing device 20, is referred to as "idle rotation of the photoconductor 12". The idle rotation of the photoconductor 12 is periodically performed to prevent the occurrence of streaks on an image formed on the surface of the photoconductor 12 due to a change in state during aging of the charging device 14, for example.

In still another non-limiting example, the third period may be a period during which toner is ejected onto each of the photoconductors 12 from the corresponding developing device 20. The operation of ejecting toner from the developing device 20 is performed for, for example, the maintenance of the image forming unit 84, such as replacement of the developing device 20 and replacement of a toner cartridge (not illustrated) from which toner is supplied to the developing device 20.

In still another non-limiting example, the third period may be a warm-up period of each of the charging devices 14. The charging device 14 is caused to warm up to prepare for the formation of an image. For example, the process of allowing the charging device 14 to warm up is a process in which the charging device 14, which is in a stopped state, is applied with a DC voltage that is progressively increased and then an AC voltage is superimposed on the DC voltage to make a superimposition voltage applied to the charging device 14 reach the target voltage.

In still another non-limiting example, the third period may be a cool-down period of each of the charging devices 14. The charging device 14 is caused to cool down to stop its operation after the formation of an image. For example, the process of stopping the operation of the charging device 14 is a process in which the charging device 14, which is applied with the superimposition voltage, is applied with a DC voltage that is progressively decreased to stop the application of the DC voltage, followed by stopping the application of the AC voltage to eventually stop the application of the superimposition voltage to the charging device 14.

In addition, the image forming apparatus 10 according to this exemplary embodiment further performs control to reduce the voltage applied to each of the charging devices 14 during the third period compared to the voltage applied to the charging device 14 during the second period while the charging device 14 charges the surface of the corresponding photoconductor 12. Specifically, in the image forming apparatus 10, a superimposition voltage V1, which is equal to a voltage determined in advance as a superimposition voltage applied for normal image formation, is applied to the charging device 14 during the second period.

In the image forming apparatus 10, furthermore, during the warm-up period of the charging device 14 within the third period, as described above, the DC voltage is progressively increased and the superimposition voltage V1 is applied to the charging device 14 with the DC voltage progressively increased. In the image forming apparatus 10, furthermore, during the cool-down period of the charging device 14 within the third period, as described above, the DC voltage is progressively decreased from the superimposition voltage V1 to eventually stop the application of the superimposition voltage to the charging device 14.

In the image forming apparatus 10, furthermore, during a period other than the warm-up and cool-down period of the charging device 14 within the third period, for example, a DC voltage equal to the DC voltage included in the superimposition voltage V1 is applied with an AC voltage having a predetermined ratio (for example, 80%) in a range exceeding 0% and less than 100% of the AC voltage included in the superimposition voltage V1 to produce a superimposition voltage V2 which is then applied to the charging device 14.

The voltage applied during the period of normal image formation may be, for example, a value obtained, by experiment or the like using an actual model of the image forming apparatus 10, as a voltage that provides an image to be formed with acceptable quality. The predetermined ratio may be, for example, a value obtained, by experiment or the like using an actual model of the image forming apparatus 10, as a ratio that provides an acceptable result of processing during the period other than the warm-up and cool-down period of the charging device 14 within the third period.

In the following, the state in which the charging device 14 is applied with the superimposition voltage V1 is referred to as "high AC voltage applying state (or high-AC application state)", and the state in which the charging device 14 is applied with the superimposition voltage V2 is referred to as "low AC voltage applying state (or low-AC application state)".

Figure 3:
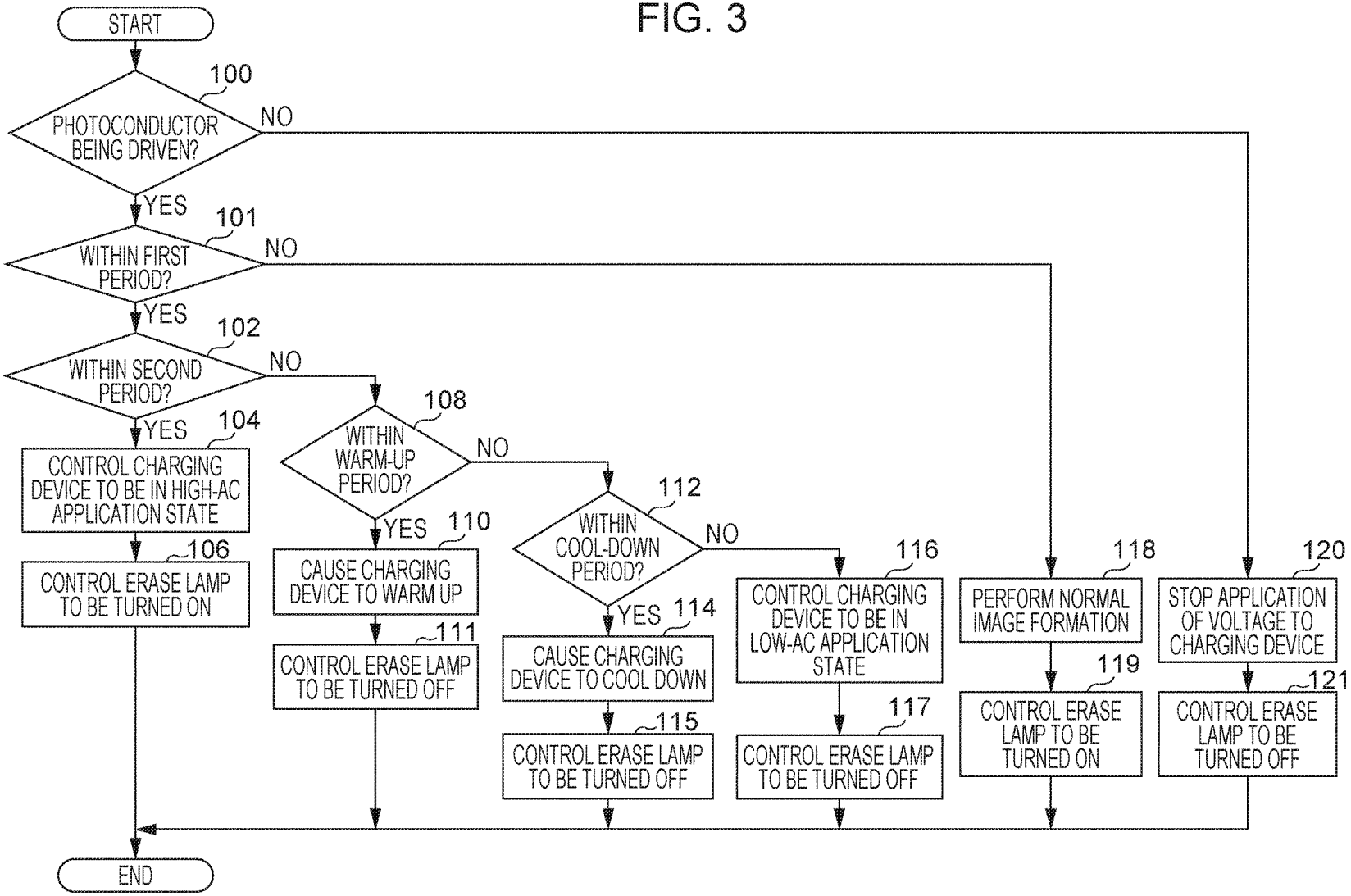
FIG. 3 is a flowchart illustrating the process flow of a charge elimination control processing program according to the exemplary embodiment.

Next, an operation of the image forming apparatus 10 according to this exemplary embodiment will be described with reference to FIG. 3. FIG. 3 is a flowchart illustrating the process flow of a charge elimination control processing program executable by the CPU 70. The charge elimination control processing program is executed at predetermined intervals (such as every one second) with, for example, the power switch of the image forming apparatus 10 being turned on. The charge elimination control processing program is installed in the ROM 72 in advance. Here, no description is given with respect to the processing operations of controlling the components of the image forming unit 84, except for control operations to apply a voltage to each of the charging devices 14 during the first period and to control the level of charge elimination performed by each of the erase lamps 29, to avoid the diagram becoming too complex.

Referring to FIG. 3, in step 100, the CPU 70 determines whether or not each of the photoconductors 12 is being driven. The CPU 70 proceeds to step 101 if a positive determination is made in step 100, and proceeds to step 120 if a negative determination is made in step 100. In step 101, the CPU 70 determines whether or not the point in time at which the processing of step 101 is being performed is within the first period. The CPU 70 proceeds to step 102 if a positive determination is made in step 101, and proceeds to step 118 if a negative determination is made in step 101. In step 102, the CPU 70 determines whether or not the point in time at which the processing of step 102 is being performed is within the second period. If a positive determination is made, the CPU 70 proceeds to step 104. If a negative determination is made, the CPU 70 determines that the point in time is within the third period, and then proceeds to step 108.

In step 104, the CPU 70 controls the charging device 14 to be in the high-AC application state. Then, in step 106, the CPU 70 controls the erase lamp 29 to be turned on, and then the charge elimination control process ends.

On the other hand, in step 108, the CPU 70 determines whether or not the point in time at which the processing of step 108 is being performed is within the warm-up period of the charging device 14. The CPU 70 proceeds to step 110 if a positive determination is made in step 108, and proceeds to step 112 if a negative determination is made in step 108. In step 110, the CPU 70 performs a process for causing the charging device 14 to warm up as described above. Then, in step 111, the CPU 70 controls the erase lamp 29 to be turned off, and then the charge elimination control process ends.

In step 112, the CPU 70 determines whether or not the point in time at which the processing of step 112 is being performed is within the cool-down period of the charging device 14. The CPU 70 proceeds to step 114 if a positive determination is made in step 112, and proceeds to step 116 if a negative determination is made in step 112. In step 114, the CPU 70 performs a process for causing the charging device 14 to cool down as described above. Then, in step 115, the CPU 70 controls the erase lamp 29 to be turned off in a way similar to that in step 111 described above, and then the charge elimination control process ends.

In step 116, the CPU 70 controls the charging device 14 to be in the low-AC application state. Then, in step 117, the CPU 70 controls the erase lamp 29 to be turned off in a way similar to that in step 111 described above, and then the charge elimination control process ends.

In step 118, the CPU 70 controls the image forming unit 84 to form, based on input image data, an image indicated by the image data on a sheet P in accordance with the image forming process described above. Then, in step 119, the CPU 70 controls the erase lamp 29 to be turned on in a way similar to that in step 106 described above, and then the charge elimination control process ends.

In step 120, the CPU 70 stops the application of a superimposition voltage to the charging device 14 and controls the charging device 14 to be turned off. Then, in step 121, the CPU 70 controls the erase lamp 29 to be turned off in a way similar to that in step 111 described above, and then the charge elimination control process ends.

Figure 4:
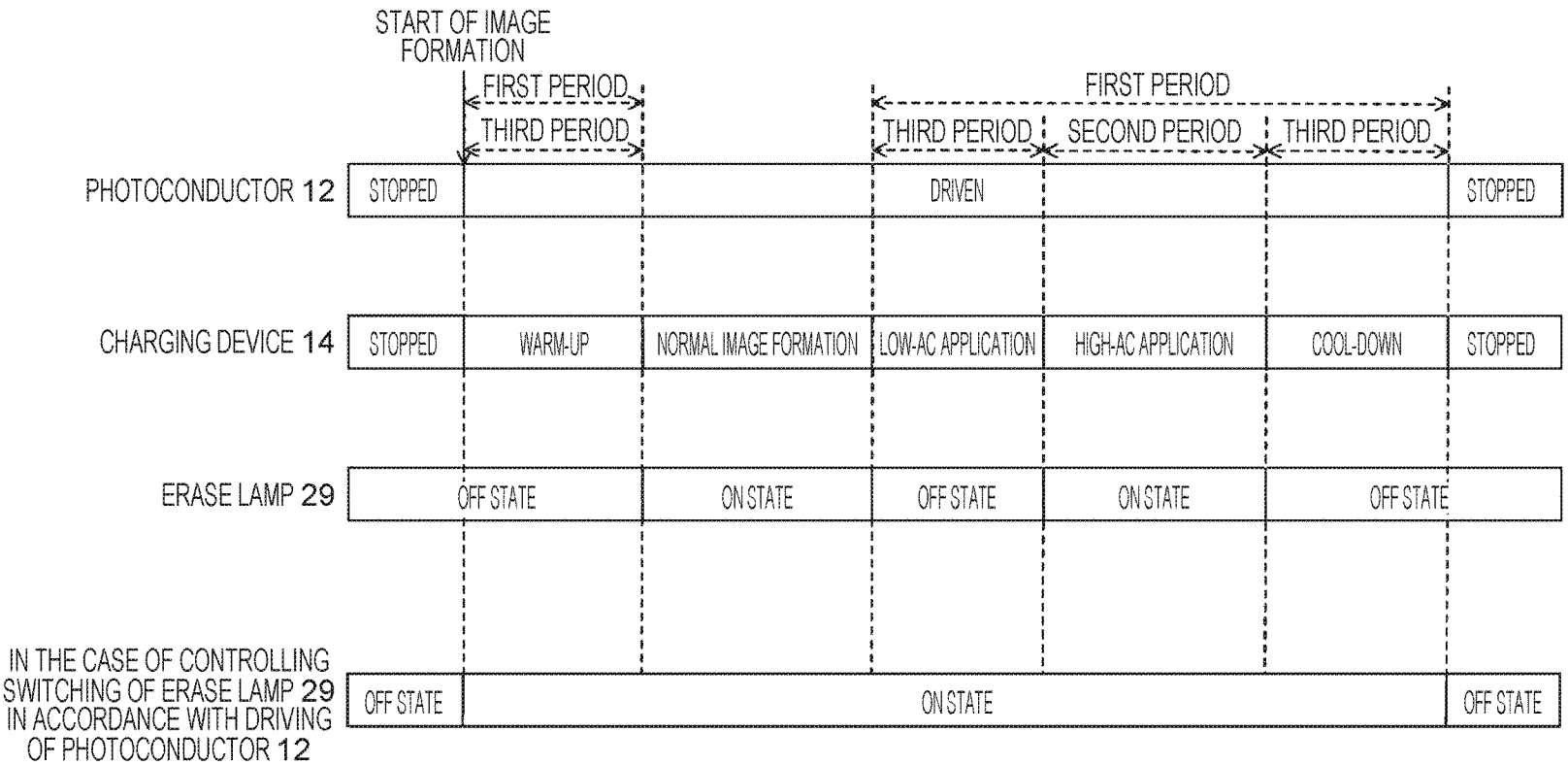
FIG. 4 is a timing chart illustrating an example charge elimination control process according to the exemplary embodiment.

FIG. 4 is an example timing chart illustrating the state transition of the principal components of the image forming unit 84 while the charge elimination control process described above is performed. In FIG. 4, a timing chart is illustrated, by way of example, in which the image forming unit 84, which is in a stopped state, is consecutively subjected to processing in the order of normal image formation, the formation of a toner band, and the formation of a patch image, and thereafter the operation of the image forming unit 84 is stopped.

In FIG. 4, the first row represents the state of each of the photoconductors 12, the second row represents the state of the corresponding charging device 14, and the third row represents the state of the corresponding erase lamp 29. In FIG. 4, furthermore, the fourth row represents the state of the corresponding erase lamp 29 in a case where, unlike the control according to this exemplary embodiment, the switching of the erase lamp 29 is controlled in accordance with the driving of the corresponding photoconductor 12.

As indicated in the first row in FIG. 4, the photoconductor 12 is driven when image data indicating an image to be formed and instructions for forming an image are input and when the formation of an image starts.

In contrast, as indicated in the second row in FIG. 4, the charging device 14 is kept in the low-AC application state during a period in which the charging device 14 warms up for normal image formation and in which a toner band is formed. The charging device 14 is kept in the high-AC application state during a period in which a patch image is formed, and is caused to cool down for termination. In other words, the charging device 14 is applied with a lower superimposition voltage during the third period than during the second period within the first period.

As indicated in the third row in FIG. 4, the erase lamp 29 is kept in an on state during a period in which normal image formation is performed and during a period in which a patch image is formed, and is kept in an off state during the remaining period. In other words, the erase lamp 29 exhibits a lower level of charge elimination during the third period than during the second period within the first period.

In contrast, as indicated in the fourth row in FIG. 4, in the case where the switching of the erase lamp 29 is controlled in accordance with the driving of the photoconductor 12, the erase lamp 29 is kept in an on state even during the third period. In this exemplary embodiment, accordingly, the amount of erase light with which the photoconductor 12 is irradiated from the erase lamp 29 is reduced compared to the case of switching between the on state and off state of the erase lamp 29 in accordance with the driving of the photoconductor 12. This may result in an extended life of the photoconductor 12.

In the exemplary embodiment described above, each of the erase lamps 29 is kept in an off state during the third period, by way of example but not limitation. Alternatively, each of the erase lamps 29 may be kept in an on state during the third period if the level of charge elimination performed by the erase lamp 29 during the third period is lower than that during the second period. As an example, the surface of each of the photoconductors 12 may be irradiated with a smaller amount of erase light from the corresponding erase lamp 29 during the third period than that during the second period.

In the exemplary embodiment described above, furthermore, a charge eliminator that eliminates residual charge from the surface of each of the photoconductors 12 is implemented as the erase lamp 29, by way of example but not limitation. The charge eliminator may be implemented as any member other than the erase lamp 29, such as a member configured to eliminate residual charge from the surface of each of the photoconductors 12 with the member coming into contact with the surface of the photoconductor 12.

In the exemplary embodiment described above, furthermore, the charge elimination control processing program is installed in the ROM 72 in advance, by way of example but not limitation. For example, the charge elimination control processing program may be provided after being stored in a storage medium such as a compact disk read-only memory (CD-ROM) or may be provided via a network.

In the exemplary embodiment described above, furthermore, the charge elimination control process is implemented in software configuration by using a computer through the execution of a program, by way of example but not limitation. For example, the charge elimination control process may be implemented in hardware configuration or in a combination of hardware configuration and software configuration.

Additionally, it is to be understood that the configuration (see FIG. 1) of the image forming apparatus 10 described with reference to the foregoing exemplary embodiment is an example and that components may be omitted, if unnecessary, or additional components may be included within the scope not departing from the gist of the present invention.

It is also to be understood that the process flow (see FIG. 3) of the charge elimination control processing program described with reference to the foregoing exemplary embodiment is an example and that steps may be omitted, if unnecessary, additional steps may be included, or steps may be reordered within the scope not departing from the gist of the present invention.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a charger that charges a surface of an image carrier;

a charge eliminator that eliminates residual charge from the surface of the image carrier charged by the charger; and a controller that performs control to reduce a level of charge elimination performed by the charge eliminator during a third period compared to a level of charge elimination performed by the charge eliminator during a second period in which an image for determining an image-forming condition is formed, the third period being a period other than the second period within a first period that is a period, other than a period of normal image formation, during which the surface of the image carrier is charged by the charger.

2. The image forming apparatus according to claim 1, wherein the controller further performs control to reduce a voltage applied to the charger during the third period compared to a voltage applied to the charger during the second period while the charger charges the surface of the image carrier.

3. The image forming apparatus according to claim 1, wherein the controller performs control to reduce the level of charge elimination by turning off the charge elimination performed by the charge eliminator.

4. The image forming apparatus according to claim 2, wherein the controller performs control to reduce the level of charge elimination by turning off the charge elimination performed by the charge eliminator.

5. An image forming method comprising:

charging a surface of an image carrier;

eliminating residual charge from the charged surface of the image carrier; and performing control to reduce a level of charge elimination performed during a third period compared to a level of charge elimination performed during a second period in which an image for determining an image-forming condition is formed, the third period being a period other than the second period within a first period that is a period, other than a period of normal image formation, during which the surface of the image carrier is charged.

6. A non-transitory computer readable medium storing a program causing a computer to execute a process for image formation, the process comprising:

charging a surface of an image carrier;

eliminating residual charge from the charged surface of the image carrier; and performing control to reduce a level of charge elimination performed during a third period compared to a level of charge elimination performed during a second period in which an image for determining an image-forming condition is formed, the third period being a period other than the second period within a first period that is a period, other than a period of normal image formation, during which the surface of the image carrier is charged.

* * * * *